US010782083B2

(12) United States Patent
Deros

(10) Patent No.: US 10,782,083 B2
(45) **Date of Patent: *Sep. 22, 2020**

(54) MUZZLE DEVICE

(71) Applicant: Mark A. Deros, Lubbock, TX (US)

(72) Inventor: Mark A. Deros, Lubbock, TX (US)

( * ) Notice: Subject to any disclaimer, the term of this patent is extended or adjusted under 35 U.S.C. 154(b) by 50 days.

This patent is subject to a terminal disclaimer.

(21) Appl. No.: 16/158,005

(22) Filed: Oct. 11, 2018

(65) Prior Publication Data

US 2019/0041155 A1 Feb. 7, 2019

Related U.S. Application Data

(63) Continuation of application No. 15/441,118, filed on Feb. 23, 2017, now Pat. No. 10,126,085, which is a continuation-in-part of application No. 15/166,644, filed on May 27, 2016, now abandoned.

(51) Int. Cl.
*F41A 21/36* (2006.01)
*F41A 21/34* (2006.01)

(52) U.S. Cl.
CPC ..... *F41A 21/36* (2013.01); *F41A 21/34* (2013.01)

(58) Field of Classification Search
CPC ..... F41A 21/34; F41A 21/36; F41A 21/38
See application file for complete search history.

(56) References Cited

U.S. PATENT DOCUMENTS

| | | | | |
|---|---|---|---|---|
| 7,143,680 | B2 * | 12/2006 | Bender | F41A 21/38 89/14.3 |
| 8,578,832 | B2 * | 11/2013 | Adolphsen | F41A 21/02 89/14.3 |
| 9,310,152 | B1 * | 4/2016 | Poling | F41A 21/36 |
| 9,835,399 | B1 * | 12/2017 | Lessard | F41A 21/34 |
| 10,126,085 | B2 * | 11/2018 | Deros | F41A 21/34 |
| 10,145,637 | B2 * | 12/2018 | Hwang | F41A 21/36 |
| 10,209,022 | B1 * | 2/2019 | Oglesby | F41A 21/34 |
| 2019/0017770 | A1 * | 1/2019 | Lake | F41A 21/28 |
| 2019/0086174 | A1 * | 3/2019 | Scharer | F41A 21/36 |

* cited by examiner

*Primary Examiner* — Joshua T Semick
(74) *Attorney, Agent, or Firm* — Sarah Hegi Simpson; Simpson Law

(57) ABSTRACT

A muzzle device for simultaneously reducing recoil, muzzle rise and muzzle flash is disclosed. The muzzle device generally comprises a body including a cylindrical wall, wherein the body has a proximal end configured for attachment to a firearm muzzle and a distal end. The muzzle device further includes a projectile opening extending from the proximal end to the distal end. A plurality of uniquely designed radial baffles and vent openings are arranged through the body of the disclosed muzzle device.

12 Claims, 9 Drawing Sheets

MUZZLE DEVICE

CROSS-REFERENCE TO RELATED APPLICATIONS

This application is a continuation application of U.S. patent application Ser. No. 15/441,118, filed on Feb. 23, 2017, which is a continuation-in-part application of U.S. patent application Ser. No. 15/166,644, filed on May 27, 2016, and now abandoned, the disclosures of which are incorporated herein by reference.

BACKGROUND OF THE INVENTION

1. Field of the Invention

The present invention generally relates to a muzzle device. More specifically, the present invention relates to a muzzle device attachable to the muzzle end of a firearm for simultaneously countering recoil, reducing unwanted rising of the barrel, and suppressing muzzle flash that normally occurs after firing.

2. Description of Related Art

Currently, muzzle brakes are used in various forms on firearms to reduce both recoil and muzzle rise or muzzle climb. Recoil is the backward momentum of a firearm after it is discharged, which is a counter force to the forward momentum of the projectile and exhaust gases exiting the firearm. Muzzle rise is the tendency of the muzzle end of the barrel to rise after firing, which occurs primarily because, for most firearms, the centerline of the barrel is above the center of contact between the shooter and the grips and stock of the firearm. The reactive forces from the fired bullet and propellant gases exiting the muzzle act directly down the centerline of the barrel. If that line of force is above the center of the contact points, this creates a force that makes the muzzle end rise upward.

Additionally, muzzle flash suppressor devices are currently used on firearms to manipulate vented gases to reduce or eliminate muzzle flash—the visible light of a muzzle blast, which expels high temperature and high pressure gases from the muzzle of a firearm.

Currently, a need exists for a muzzle device that is designed to simultaneously counter recoil, reduce muzzle rise, and suppress muzzle flash. Unlike existing devices that focus on correcting one of these unwanted reactions of a fired projectile, a need exists for a muzzle device that simultaneously reduces all three of the above mentioned physical effects of firing a firearm.

In view of the foregoing, it is apparent that a need exists in the art for a muzzle device which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above described drawbacks associated with current muzzle devices. To achieve these and other advantages and in accordance with the purpose of the invention, as embodied and broadly described, the present disclosure describes a muzzle device that simultaneously reduces recoil, muzzle rise, and muzzle flash.

The disclosed muzzle device generally comprises a body including a cylindrical wall, wherein the body has a proximal end configured for attachment to the firearm muzzle and a distal end. The muzzle device further includes a projectile opening extending therethrough and a plurality of radial baffles and vent openings formed through the body of the device.

The disclosed apparatus is believed to solve, in a new and unique fashion, many problems related to current muzzle devices by providing a single device that counteracts many physical effects of firing a projectile from a firearm. This, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and form a part of the specification, illustrate embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

The terms "left," "right," "upper," and "lower" are used in the specification to describe the embodiments of the invention as illustrated in the accompanying Figures. It should be appreciated that in actual use, an embodiment of the invention may be rotated as needed to accomplish the objectives of the invention. As a result of such rotation, the various terms used herein of "left," "right," "upper," and "lower" and the like may not literally apply to a particular arrangement. Such terms are relative and are used herein to describe the Figures for illustration purposes only and are not intended to limit the embodiments shown to any particular orientation.

Referring now to FIGS. 1A-9, exemplary embodiments of a muzzle device and methods of use in accordance with the present disclosure are illustrated.

Figure 1A:
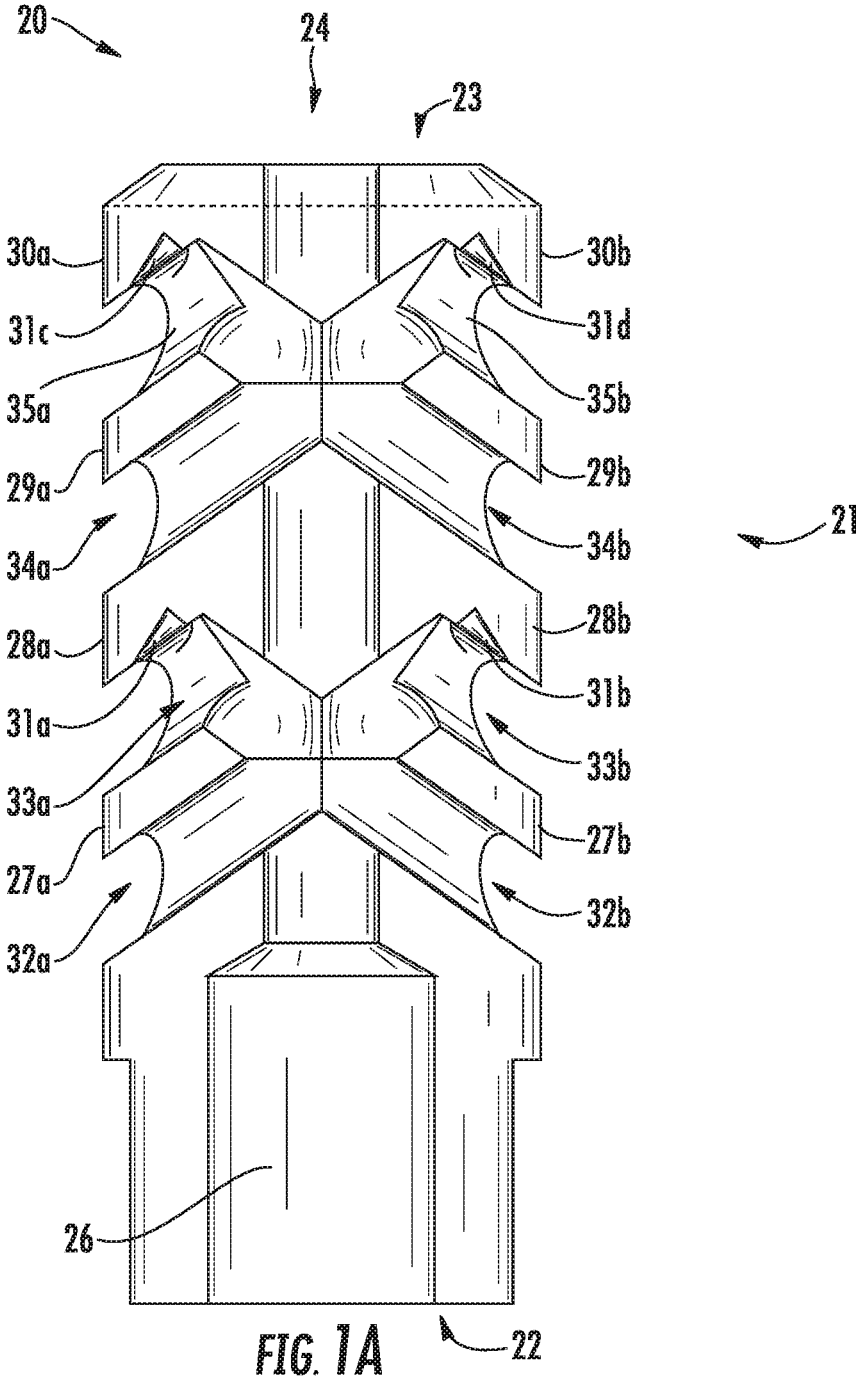
FIG. 1A is a side elevation view of a muzzle device showing the internal structure of the muzzle device, wherein the muzzle device is constructed in accordance with the teachings of the present disclosure.

Turning to the Figures for illustrative purpose, FIG. 1A is a side elevation view of a muzzle device according to the present disclosure. The muzzle device 20 depicted in FIGS. 1A-1B generally includes a body 21, the body having a proximal end 22 and a distal end 23; a cylindrical wall 25 defining the body; a projectile opening 24 extending through the body; an attachment opening 26 on the proximal end of the device configured to attach to a muzzle end of a firearm; and a plurality of radial baffles and vent openings formed through the body of the device.

Figure 1B:
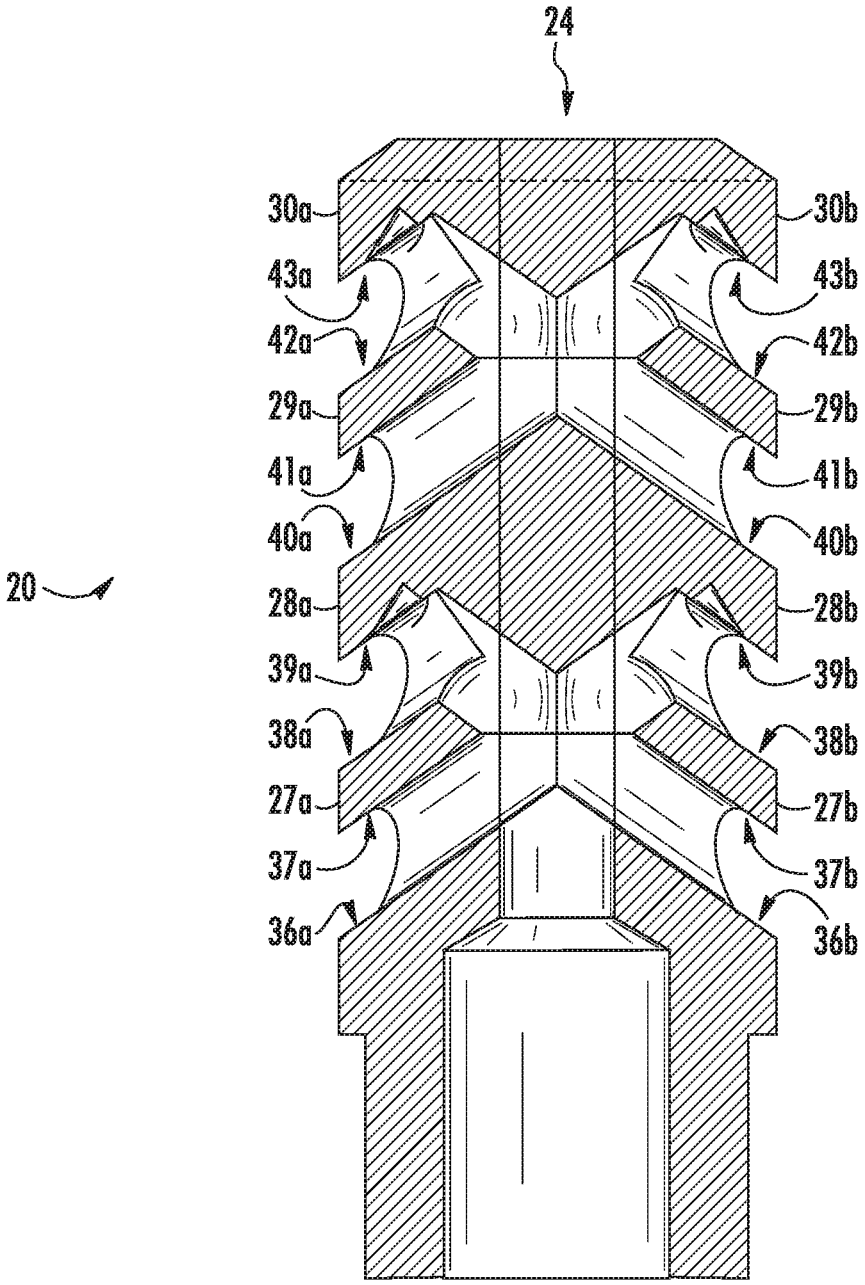
FIG. 1B is a side elevation view of a muzzle device showing the internal structure of the muzzle device, wherein the muzzle device is constructed in accordance with the teachings of the present disclosure.

As illustrated in FIGS. 1A-1B, the muzzle device may include a first left baffle 27*a*, a first right baffle 27*b*, a second left baffle 28*a*, and second right baffle 28*b*, a third left baffle 29*a*, a third right baffle 29*b*, a fourth left baffle 30*a* and a fourth right baffle 30*b*. Additionally, the muzzle device shown in FIGS. 1A-1B includes a first left vent opening 32*a* defined by a lower wall 36*a* and an upper baffle wall 37*a*, a first right vent opening 32*b* defined by a lower wall 36*b* and an upper baffle wall 37*b*, a second left vent opening 33*a* defined by a lower baffle wall 38*a* and an upper baffle wall 39*a*, a second right vent opening 33*b* defined by a lower baffle wall 38*b* and an upper baffle wall 39*b*, a third left vent opening 34*a* defined by a lower baffle wall 40*a* and an upper baffle wall 41*a*, a third right vent opening 34*b* defined by a lower baffle wall 40*b* and an upper baffle wall 41*b*, a fourth left vent opening 35*a* defined by a lower baffle wall 42*a* and an upper baffle wall 43*a*, and a fourth right vent opening 35*b* defined by a lower baffle wall 42*b* and an upper baffle wall 43*b*. As shown in FIGS. 1A-1B, the muzzle device may further include one or more gas traps 31*a*, 31*b*, 31*c* and 31*d* formed in one or more of the upper baffle walls of the vent openings. Such gas traps are arranged and configured to trap additional gases exiting the firearm after firing. While the attached Figures, illustrate a muzzle device including four left baffles and four right baffles, and four left vent openings and four right vent openings, other embodiments are contemplated wherein more or less than four left baffles, four right baffles, four left vent openings, and/or four right vent openings are utilized, as will be appreciated by those skilled in the art. Furthermore, the device may be designed to include at least three rows of baffles rather than only two rows of left and right baffles as shown in the attached drawings.

Figure 4:
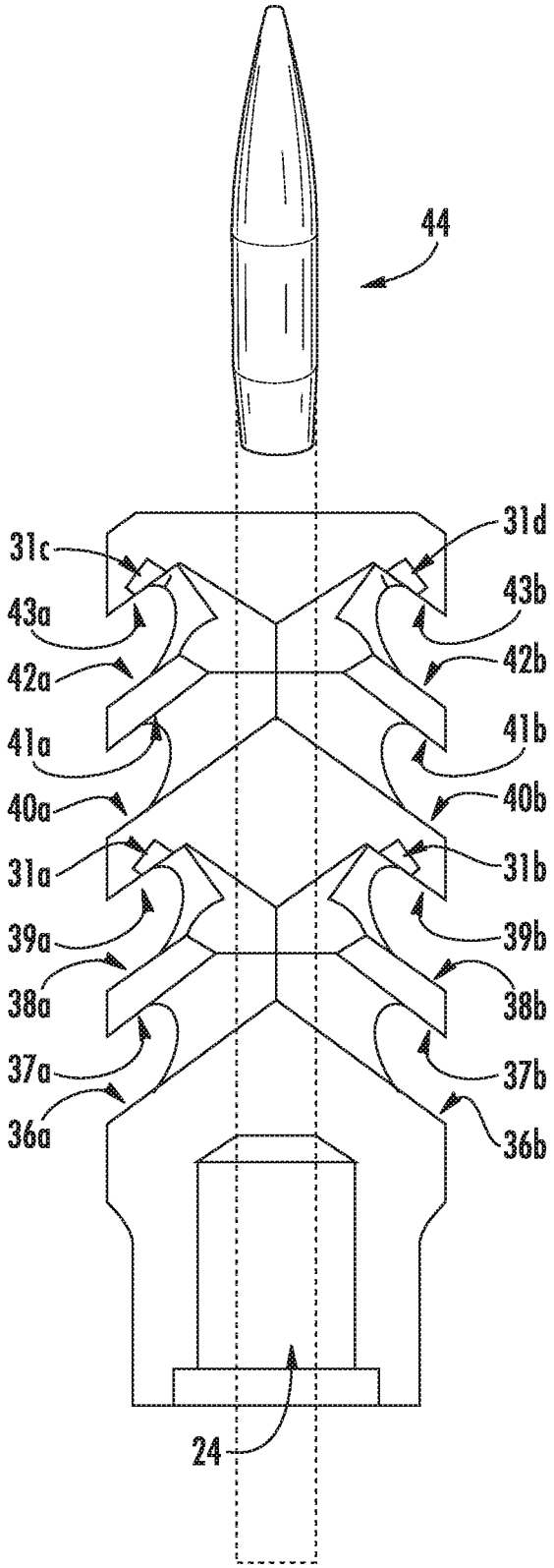
FIG. 4 is a side elevation view of a muzzle device showing the internal structure of the muzzle device, wherein the muzzle device is constructed in accordance with the teachings of the present disclosure.
Figure 5:
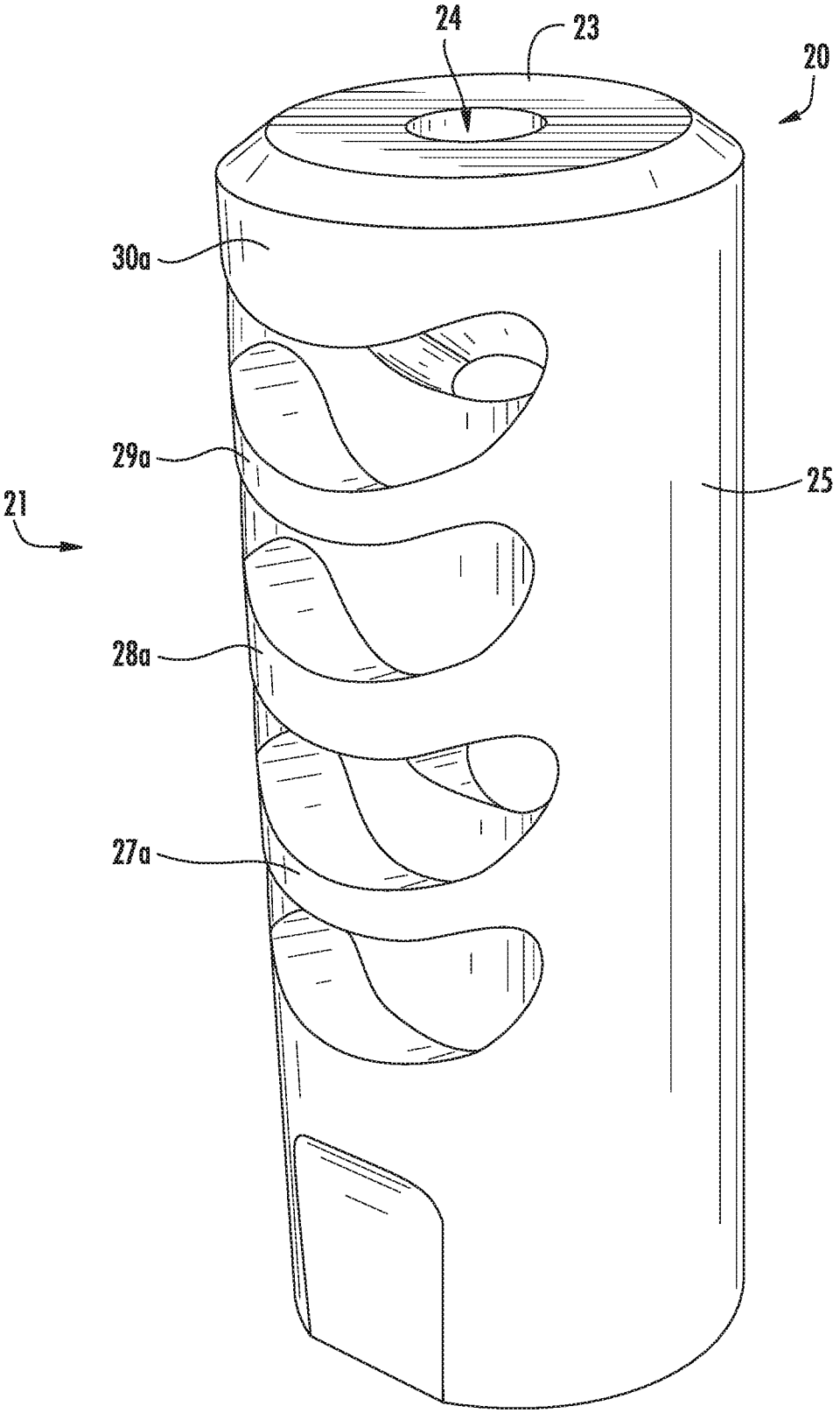
FIG. 5 is a side perspective view of a muzzle device constructed in accordance with the teachings of the present disclosure.

Turning to FIG. 4, a muzzle device is illustrated showing a projectile 44 exiting through the projectile opening 24, which extends through the body of the muzzle device. The projectile opening of the muzzle device shown in FIG. 4 defines a bore hole extending longitudinally through the center of the body from the proximal end to the distal end.

Figure 3A:
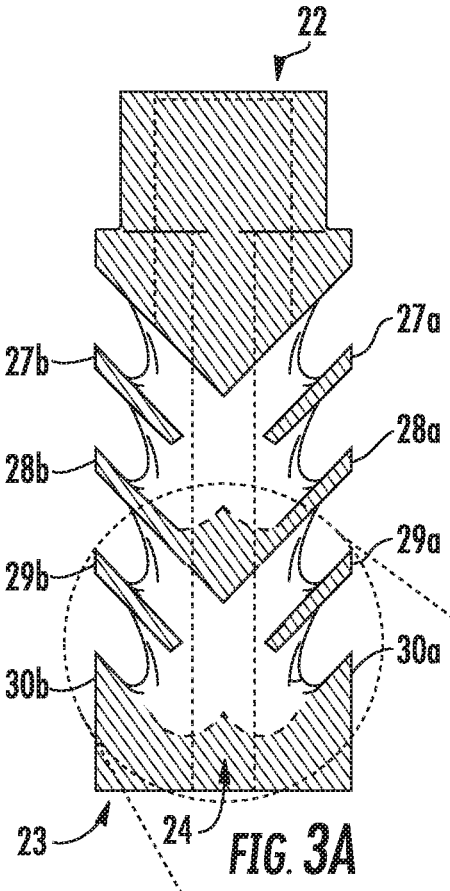
FIG. 3A is a side elevation view of a muzzle device showing the internal structure of the muzzle device, wherein the muzzle device is constructed in accordance with the teachings of the present disclosure.
Figure 3B:
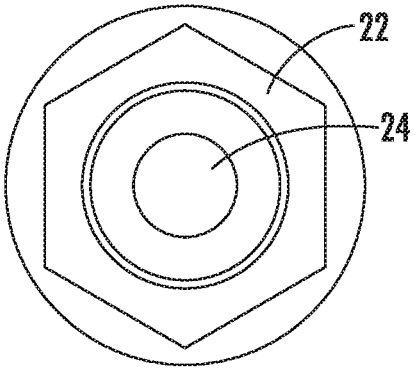
FIG. 3B is an end view of FIG. 3A.
Figure 3C:
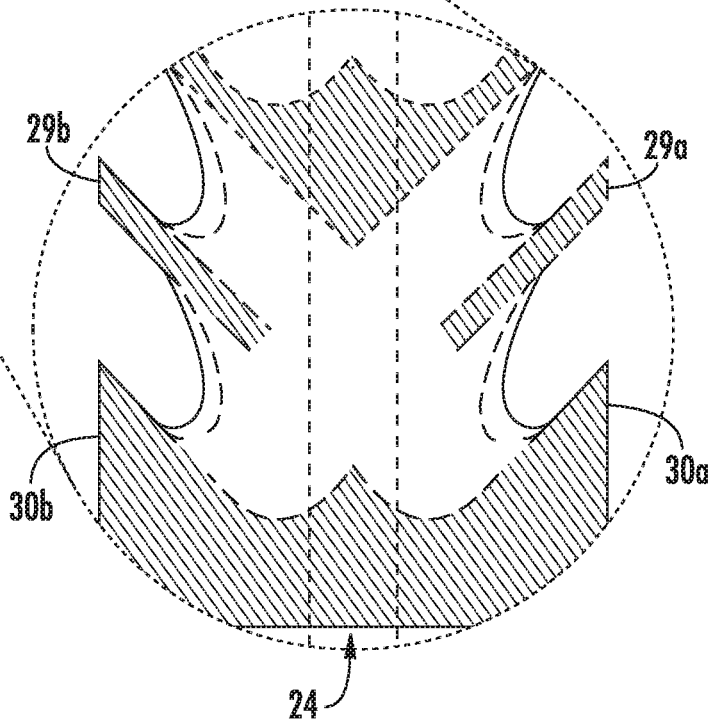
FIG. 3C is a magnified partial view of FIG. 3A.

As can be seen in FIG. 4, the lower wall 36*a* of the first left vent opening 32*a* and the lower wall 36*b* of the first right vent opening 32*b* converge. The projectile opening extends through both the lower wall 36*a* of the first left vent opening 32*a* and the lower wall 36*b* of the first right vent opening 32*b*. Likewise, the walls of the second left baffle 28*a* and the walls of the second right baffle 28*b* converge such that the upper baffle wall 39*a* of the second left vent opening 33*a* converges with the upper baffle wall 39*b* of the second right vent opening 33*b*, and the lower baffle wall 40*a* of the third left vent opening 34*a* converges with the lower baffle wall 40*b* of the third right vent opening 34*b*. Again the projectile opening 24 extends through the second left baffle and the second right baffle and through the upper walls of the second vent openings and the lower walls of the third vent openings. In the embodiment shown in FIGS. 1A-1B, the upper baffle wall 39*a* of the second left vent opening 33*a* is defined as two inclined walls which meet at an apex. Additionally the upper baffle wall 39*b* of the second right vent opening 33*b* is defined as two inclined walls which meet at an apex. The upper baffle wall 39*a* of the second left vent opening 33*a* converges with the upper baffle wall 39*b* of the second right vent opening 33*b* at the base of each respective wall, as can be seen in FIGS. 1A-1B. Other embodiments are contemplated wherein the upper baffle walls 39*a* and 39*b* of the second vent openings 33*a* and 33*b* and/or the fourth vent openings 35*a* and 35*b* are formed with a more rounded apex, as shown in FIGS. 3A and 3C. In such an embodiment, the upper baffle wall 39*a* of the second left vent opening 33*a* still converges with the upper baffle wall 39*b* of the second right vent opening 33*b* at the base of each respective wall, as can be seen in FIGS. 3A and 3C. Furthermore, the fourth left baffle 30*a* and the fourth right baffle 30*b* converge such that the upper baffle wall 43*a* of the fourth left vent opening 35*a* converges with the upper baffle wall 43*b* of the fourth right vent opening 35*b*. Again the projectile opening extends through the fourth left baffle and the fourth right baffle and through the upper walls of the fourth vent openings.

In contrast to the second and fourth baffles, wherein the second left baffle converges with the second right baffle and the second baffles extend all the way in to the center of the device and surround the projectile opening and wherein the fourth left baffle converges with the fourth right baffle and the fourth baffles extend all the way in to the center of the device and surround the projectile opening, the first left baffle 27*a* does not converge with or intersect the first right baffle 27*b*, such that the upper baffle wall 37*a* of the first left vent opening 32*a* does not converge with the upper baffle wall 37*b* of the first right vent opening 32*b*, and the lower baffle wall 38*a* of the second left vent opening 33*a* does not converge with the lower baffle wall 38*b* of the second right vent opening 33*b*. Additionally, the first left baffle 27*a* and the first right baffle 27*b* do not extend all the way in to the projectile opening 24, as can be best seen in FIG. 4. Void space is left between the edge of the first left baffle 27*a* and the projectile opening 24, and void space is left between the edge of the first right baffle 27*b* and the projectile opening 24. Likewise, the third left baffle 29*a* does not converge with or intersect the third right baffle 29*b*, such that the upper baffle wall 41*a* of the third left vent opening 34*a* does not converge with the upper baffle wall 41*b* of the third right vent opening 34*b*, and the lower baffle wall 42*a* of the fourth left vent opening 35*a* does not converge with the lower baffle wall 42*b* of the fourth right vent opening 35*b*. Additionally, the third left baffle 29*a* and the third right baffle 29*b* do not extend all the way in to the projectile opening. Void space is left between the edge of the third left baffle 29*a* and the projectile opening 24, and void space is left between the edge of the third right baffle 29*b* and the projectile opening 24, as can be best seen in FIG. 4. The void spaces between the interior walls of the first and third baffles and the projectile opening allow for more gas to exit through the radial vent openings rather than exiting through the projectile opening.

Figure 2:
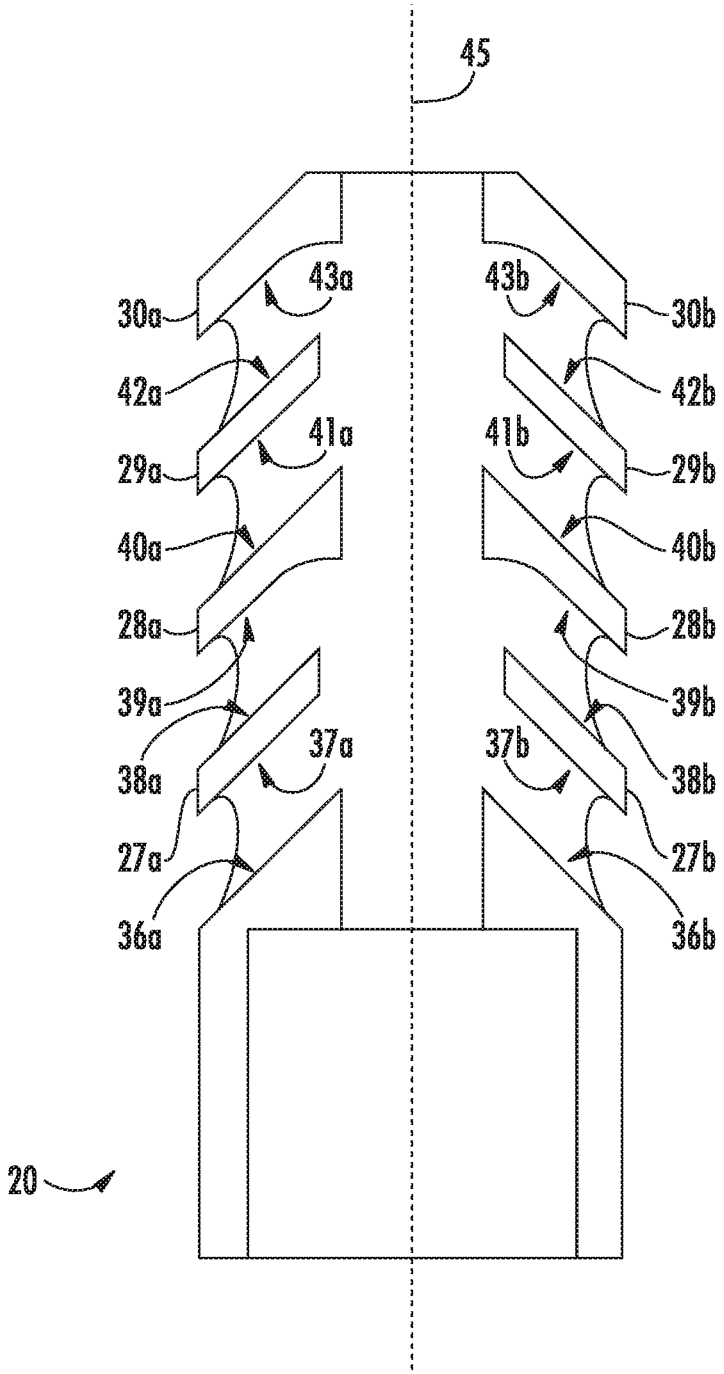
FIG. 2 is a is a sectional view of a muzzle device showing the internal structure of the muzzle device, wherein the muzzle device is constructed in accordance with the teachings of the present disclosure.

In one preferred embodiment contemplated herein, each of the baffles is positioned at an acute angle with respect to a longitudinal axis 45 of the muzzle device, as can be seen in FIG. 2. While the baffles may be positioned at a 45° angle to the longitudinal axis of the muzzle device, and in some cases, the baffles may be positioned at an angle greater than 45°, ideally the baffles will be positioned at an acute angle to the longitudinal axis of the device, such as an angle between 20° and 40°. Such angles are ideal in order to redirect and control the burst of combustion gases that follow the departure of a projectile from a firearm.

While the attached Figures illustrated the disclosed device with an attachment opening 26 configured to attach to the muzzle end of a firearm, please note that the disclosed device can be attached to a firearm using any attachment means known to those skilled in the art for attaching a muzzle brake or similar device to the muzzle end of a firearm. The proximal end of the disclosed device may be internally threaded or externally threaded to allow for attachment of the device to the muzzle end of a firearm. The disclosed device can be configured to be self-timing and easily indexed by the user. The disclosed device may also be configured for installation using a jam nut, crush washer or the like when attaching the device to the muzzle end of a firearm. Those skilled in the art will understand that many attachment methods are available, all of which are considered to be within the spirit and scope of the present disclosure.

Figure 6:
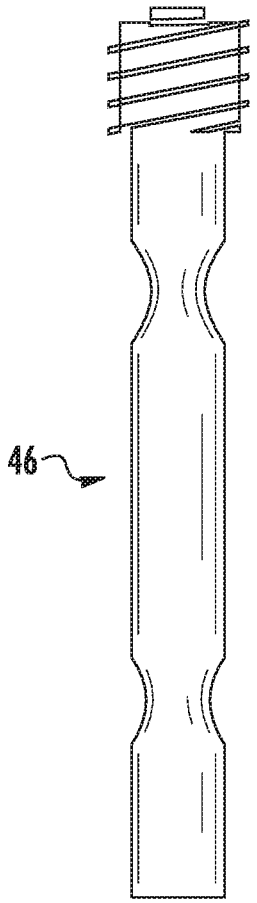
FIG. 6 is a side view of an adjustable needle of a muzzle device constructed in accordance with the teachings of the present disclosure.
Figure 7:
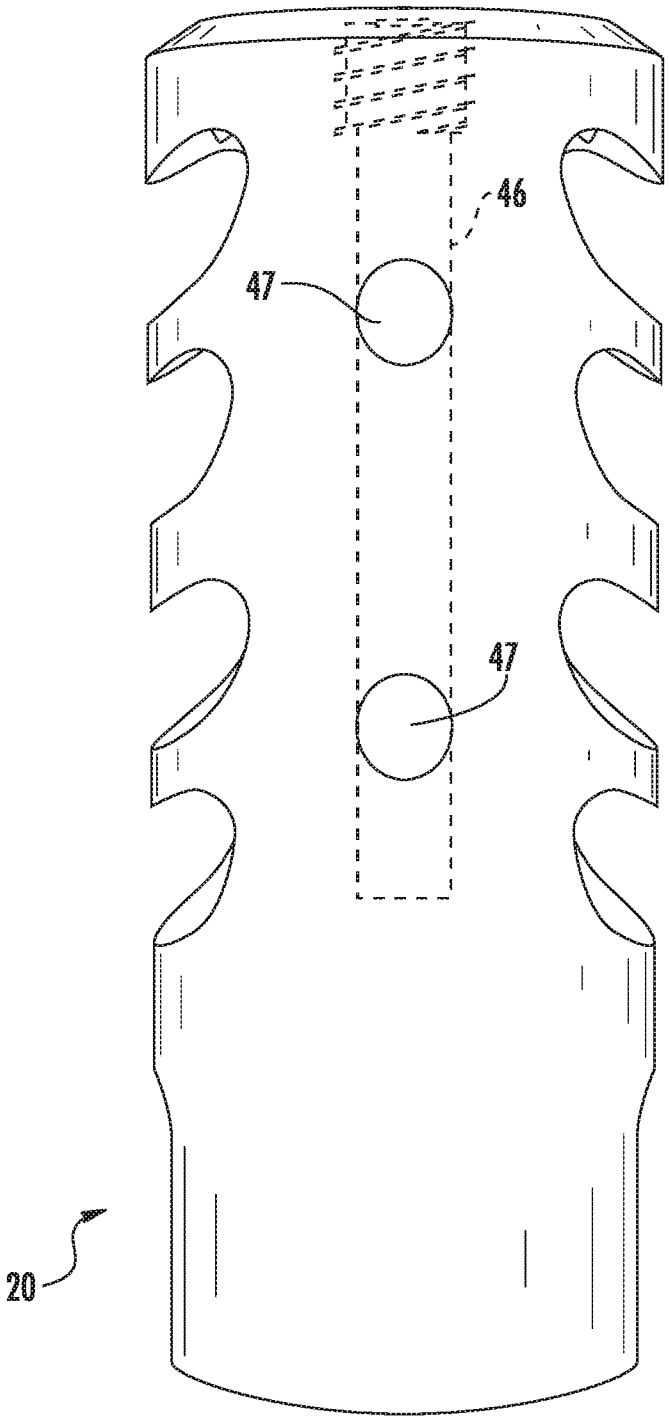
FIG. 7 is a side perspective view of a muzzle device constructed in accordance with the teachings of the present disclosure.

In another preferred embodiment contemplated herein, FIG. 7 illustrates the disclosed device further including one or more ports 47 defined as holes or slots machined into the body of the device for counteracting muzzle rise. FIG. 6 illustrates an adjustable needle 46 which may be inserted into a slot arranged and configured to house the needle in the device. The adjustable needle 46 can be adjusted to either close off one or more of the ports 47 or to allow one or more of the ports to remain open. In order to counteract muzzle rise, the ports 47 should be positioned on the top face of the device when the device is attached to the muzzle end of a firearm.

Figure 8:
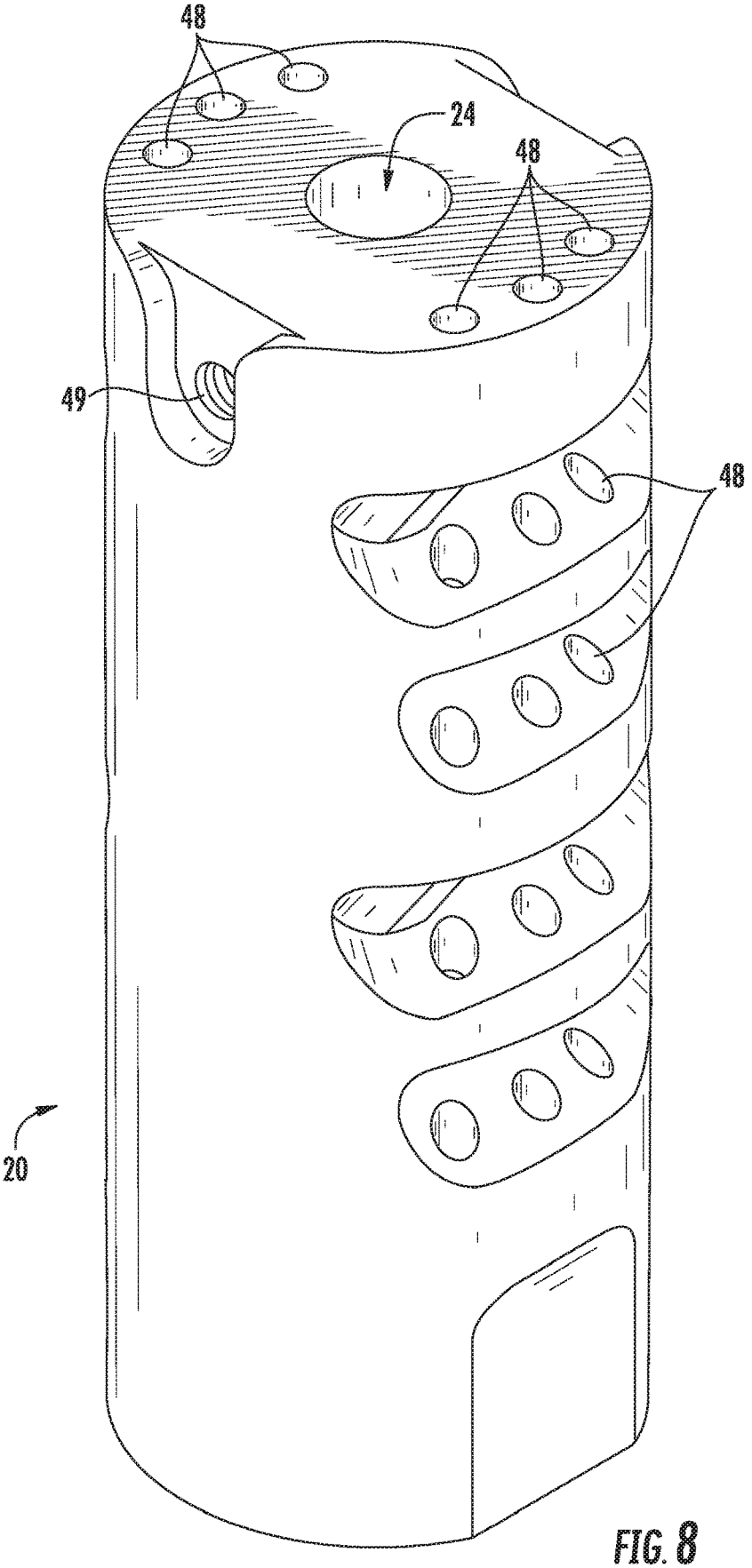
FIG. 8 is a side perspective view of a muzzle device constructed in accordance with the teachings of the present disclosure.
Figure 9:
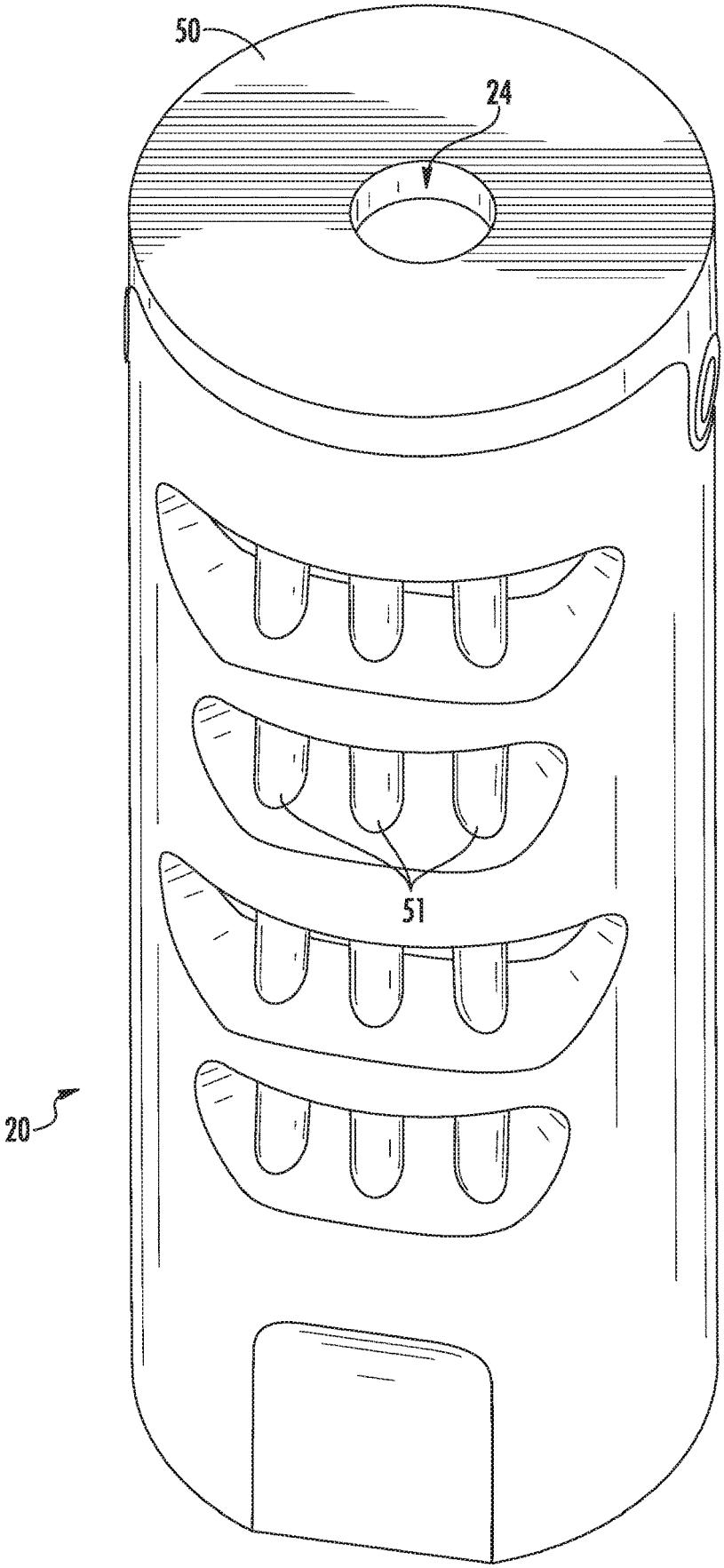
FIG. 9 is a side perspective view of a muzzle device constructed in accordance with the teachings of the present disclosure.

Turning to FIGS. 8 and 9, the disclosed device may further include gas dispersion bars 51 extending through apertures 48 formed through the baffle walls. Such gas dispersion bars 51 may be useful for gas dispersion control, diverting sound and reducing muzzle flash. The gas dispersion bars 51 may extend through one or all of the vent openings formed through the body of the device 20. Additionally, the disclosed device may further include an attachment opening 49 for receiving and retaining a top cap 50 attached to the distal end of the disclosed device 20.

It is important to note that the construction and arrangement of the elements of the apparatus provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components) without materially departing from the novel teachings and advantages of the invention.

Though the disclosed muzzle device is illustrated in the accompanying Figures with its application for reducing recoil, muzzle rise and muzzle flash, note that it is not intended to limit the spirit and scope of the present invention solely for these purposes. Many other uses of the present invention will become obvious to one skilled in the art upon acquiring a thorough understanding of the present invention. Once given the above disclosures, many other features, modifications and variations will become apparent to the skilled artisan in view of the teachings set forth herein. Such other uses, features, modifications and variations are, therefore, considered to be a part of this invention, the scope of which is to be determined by the following claims.

The invention claimed is:

1. A muzzle device comprising:

a body including a cylindrical wall, said body having a proximal end and a distal end, wherein said proximal end is configured to attach to a muzzle end of a firearm;

a projectile opening extending from said proximal end to said distal end through said body;

a first left baffle;

a first right baffle opposite said first left baffle;

a first left vent opening defined by a lower wall and an upper baffle wall;

a first right vent opening defined by a lower wall and an upper baffle wall;

wherein said lower wall of said first left vent opening converges with said lower wall of said first right vent opening, and said projectile opening extends through said lower wall of said first left vent opening and through said lower wall of said first right vent opening;

a second left baffle;

a second right baffle opposite said second left baffle;

a second left vent opening defined by a lower baffle wall and an upper baffle wall;

a second right vent opening defined by a lower baffle wall and an upper baffle wall;

wherein said first left vent opening extends into said second right vent opening and converges with said second right vent opening;

and wherein said first right vent opening extends into said second left vent opening and converges with said second left vent opening.

2. The muzzle device according to claim 1, wherein a void space separates said first left baffle from said projectile opening, and wherein a void space separates said first right baffle from said projectile opening.

3. The muzzle device according to claim 1, further comprising:

a third left baffle;

a third right baffle opposite said third left baffle;

a third left vent opening defined by a lower baffle wall and an upper baffle wall;

a third right vent opening defined by a lower baffle wall and an upper baffle wall;

a fourth left baffle;

a fourth right baffle opposite said fourth left baffle;

a fourth left vent opening defined by a lower baffle wall and an upper baffle wall;

a fourth right vent opening defined by a lower baffle wall and an upper baffle wall;

wherein said third left vent opening extends into said fourth right vent opening and converges with said fourth right vent opening;

and wherein said third right vent opening extends into said fourth left vent opening and converges with said fourth left vent opening.

4. The muzzle device according to claim 3, wherein a void space separates said third left baffle from said projectile opening, and wherein a void space separates said third right baffle from said projectile opening.

5. The muzzle device according to claim 1, further comprising one or more gas traps formed in one or more of said upper baffle walls of said vent openings.

6. The muzzle device according to claim 4, further comprising:

a first gas trap formed in said upper baffle wall of said second left vent opening;

a second gas trap formed in said upper baffle wall of said second right vent opening;

a third gas trap formed in said upper baffle wall of said fourth left vent opening; and a fourth gas trap formed in said upper baffle wall of said fourth right vent opening.

7. The muzzle device according to claim 1:

wherein said upper baffle wall of said second left vent opening is defined as two inclined walls, wherein said two inclined walls meet at an apex, and wherein said upper baffle wall of said second right vent opening is defined as two inclined walls, wherein said two inclined walls meet at an apex, and wherein said upper baffle wall of said second left vent opening converges with said upper baffle wall of said second right vent opening at the base of each respective wall.

8. The muzzle device according to claim 4:

wherein said upper baffle wall of said fourth left vent opening is defined as two inclined walls, wherein said two inclined walls meet at an apex, and wherein said upper baffle wall of said fourth right vent opening is defined as two inclined walls, wherein said two inclined walls meet at an apex, and wherein said upper baffle wall of said fourth left vent opening converges with said upper baffle wall of said fourth right vent opening at the base of each respective wall.

9. The muzzle device according to claim 7, wherein said apex is rounded.

10. The muzzle device according to claim 4, further including a longitudinal axis extending through said muzzle device, wherein said baffles are positioned at acute angles with respect to said longitudinal axis.

11. A method of manufacturing a muzzle device comprising a body including a cylindrical wall, said body having a proximal end and a distal end, wherein said proximal end is configured to attach to a muzzle end of a firearm; a projectile opening extending from said proximal end to said distal end through said body; a first left baffle; a first right baffle opposite said first left baffle; a first left vent opening defined by a lower wall and an upper baffle wall; a first right vent opening defined by a lower wall and an upper baffle wall; wherein said lower wall of said first left vent opening converges with said lower wall of said first right vent opening, and said projectile opening extends through said lower wall of said first left vent opening and through said lower wall of said first right vent opening; a second left baffle; a second right baffle opposite said second left baffle; a second left vent opening defined by a lower baffle wall and an upper baffle wall; a second right vent opening defined by a lower baffle wall and an upper baffle wall, said method comprising the following steps:

milling said first left vent opening until it extends through said projectile opening and converges with said second right vent opening; and milling said first right vent opening until it extends through said projectile opening and converges with said second left vent opening.

12. A method of manufacturing a muzzle device according to claim 11, wherein said muzzle device further comprises a third left baffle; a third right baffle opposite said third left baffle; a third left vent opening defined by a lower baffle wall and an upper baffle wall; a third right vent opening defined by a lower baffle wall and an upper baffle wall; a fourth left baffle; a fourth right baffle opposite said fourth left baffle; a fourth left vent opening defined by a lower baffle wall and an upper baffle wall; a fourth right vent opening defined by a lower baffle wall and an upper baffle wall, said method further comprising the following steps:

milling said third left vent opening until it extends through said projectile opening and converges with said fourth right vent opening; and milling said third right vent opening until it extends through said projectile opening and converges with said fourth left vent opening.

* * * * *